US008882638B2

(12) United States Patent
Escobedo et al.

(10) Patent No.: US 8,882,638 B2
(45) Date of Patent: Nov. 11, 2014

(54) EXERCISE MACHINE

(71) Applicant: Technogym S.p.A., Gambettola (IT)

(72) Inventors: Camilo Escobedo, Cesena (IT); Mauro Fabbri, Savio (IT)

(73) Assignee: Technogym S.p.A., Gambettola (IT)

( * ) Notice: Subject to any disclaimer, the term of this patent is extended or adjusted under 35 U.S.C. 154(b) by 113 days.

(21) Appl. No.: 13/827,818

(22) Filed: Mar. 14, 2013

(65) Prior Publication Data

US 2013/0252786 A1 Sep. 26, 2013

(30) Foreign Application Priority Data

Mar. 20, 2012 (IT) ..... BO2012A0149

(51) Int. Cl.
*A63B 24/00* (2006.01)

(52) U.S. Cl.
USPC ..... 482/8; 482/1; 482/9; 482/901; 434/247

(58) Field of Classification Search
USPC ..... 482/1–9, 900–902; 434/247
See application file for complete search history.

(56) References Cited

U.S. PATENT DOCUMENTS

| | | | | |
|---|---|---|---|---|
| 7,044,891 | B1 | 5/2006 | Rivera | |
| 7,253,534 | B2 * | 8/2007 | Vasilovich et al. | 290/1 R |
| 7,504,737 | B2 * | 3/2009 | Vasilovich et al. | 290/1 R |
| 7,560,822 | B1 * | 7/2009 | Hoffmann | 290/1 R |
| 7,566,979 | B1 | 7/2009 | Hartman et al. | |
| 8,485,944 | B2 * | 7/2013 | Drazan | 482/2 |
| 2009/0247366 | A1 | 10/2009 | Frumer | |
| 2009/0251296 | A1 | 10/2009 | Whelan, Jr. | |
| 2011/0234175 | A1 | 9/2011 | Hajee et al. | |

FOREIGN PATENT DOCUMENTS

| | | | |
|---|---|---|---|
| WO | 2009120604 | A2 | 10/2009 |

* cited by examiner

*Primary Examiner* — Glenn Richman

(74) *Attorney, Agent, or Firm* — Pearne & Gordon LLP

(57) ABSTRACT

An exercise machine equipped with a device designed to be driven to move by the user during a workout, by applying a muscular force against a resistant load and which includes: a detector for detecting the muscular power applied by the user to the device; a display; a computer connected to the display and having access to a memory containing a plurality of values, representative of the power nominally absorbed by a plurality of corresponding electric household appliances, and digital data for graphically representing the plurality of electric household appliances, the computer being programmed for: comparing the power detected by the detector and at least one of the power values contained in the memory; and for generating on the display, depending on the comparison, a graphical output of the comparison, including a graphical representation of at least one of the electric household appliances, generated based on the digital data.

13 Claims, 5 Drawing Sheets

EXERCISE MACHINE

BACKGROUND OF THE INVENTION

This invention relates to an exercise machine.

As is known, in the field of exercise machines, it is particularly important to be able to motivate the user to perform a workout effectively.

Several motivational methods are known which are aimed at encouraging gym users to improve workout performance.

The need has long been felt for an exercise machine that is capable of motivating users to perform workouts in a particularly effective manner.

SUMMARY OF THE INVENTION

The aim of this invention is to satisfy the above mentioned need, that is to say, to provide an exercise machine which can motivate users to perform workouts in a particularly effective manner, encouraging them to improve their performance.

This aim is fully achieved by the exercise machine and the method for managing an exercise machine forming the object of this invention.

The exercise machine of this invention comprises a device designed to be driven to move by the user during the workout, by applying a muscular force against a resistant load.

More specifically, the exercise machine is characterized in that it comprises: detection means for detecting the muscular power applied by the user to the device during the workout; a display; a computer connected to the display and having access to a memory containing a plurality of values, representative of the power nominally absorbed by a plurality of corresponding electric household appliances, and digital data for graphically representing said plurality of electric household appliances, the computer being programmed for: comparing the power detected by the detection means and at least one of the power values contained in the memory; and for generating on the display, depending on said comparison, a graphical output of said comparison, comprising a graphical representation of at least one of the electric household appliances, generated based on the digital data.

The above aim is also achieved by a method for managing an exercise machine equipped with a device designed to be driven to move by the user during the workout, by applying a muscular force against a resistant load and comprising a display and a computer connected to the display.

The method is characterized in that it comprises the following steps: preparing, in a memory, a plurality of values representative of the power nominally absorbed by a plurality of corresponding electric household appliances and digital data for graphically representing said plurality of electric household appliances; detecting the muscular power applied by the user to the device during the workout; comparing, using the computer, the power detected by the detection means and at least one of the power values contained in the memory; generating on the display, depending on the comparison, a graphical output of said comparison, comprising a graphical representation of at least one of the electric household appliances, generated based on the digital data.

BRIEF DESCRIPTION OF THE DRAWINGS

These and other characteristics of the invention will become more apparent from the following detailed description of a preferred, non-limiting example embodiment of it, with reference to the accompanying drawings, in which.

DESCRIPTION OF THE PREFERRED EMBODIMENTS

The exercise machine 1 of the invention is an exercise machine which is equipped with a device 2 configured to be driven to move by the user during a workout, by applying a muscular force against a resistant load 3.

In other words, the user sets the device 2 in motion (rotation or any reciprocating motion) and performs the workout by overcoming the resistant force defined by the load 3.

The exercise machine 1 is of a type known as "passive exercise machine".

Figure 1:
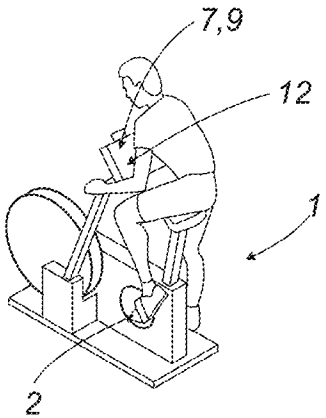
FIG. 1 illustrates a preferred embodiment of an exercise machine according to the invention.

It should be noted that the exercise machine 1 illustrated in FIG. 1 is an exercise bike.

This example must be understood as a non-limiting example, since the exercise machine 1 might also be an exercise machine of a different type.

According to the invention, the machine 1 comprises a device 2 configured to be driven to move by the user during a workout.

In the example of FIG. 1, the device 2 is a pair of pedals which the user drives in rotation to perform the workout.

The user applies a muscular force (mechanical) against the resistant load 3.

It should be noted that the resistant load 3 applied to the device 2 may be a gravitational load (for example, a stack of weights), a load defined by a mechanical friction force (for example, a mechanical brake on an exercise bike) or a resistant force defined by an electromagnetic force.

According to the invention, the machine comprises detection means 4 for detecting the muscular power (mechanical) applied by the user to the device 2.

The detection means 4 preferably comprise a sensor configured to detect the muscular power applied by the user to the device 2.

According to the invention, the machine 1 comprises a computer 5 having access to a memory containing a plurality of values representing the nominal absorbed power (hereinafter also referred to as operating power) of a plurality of electric household appliances (6*a*, 6*b*, 6*c*, 6*d*, 6*e*, 6*f*, 6*g*, 6*h*).

The nominal absorbed or operating power of an electric household appliance is the electric power necessary for operation during normal use of the appliance.

The operating power of a television, for example, is approximately 100 W.

Preferably, the power values stored in the memory fall within the range of 30 W-2 kW.

It should be noted, therefore, that each power value stored in the memory corresponds to the power nominally absorbed during the operation of an electric household appliance.

The memory also comprises a plurality of digital data items for graphically representing the electric household appliances (6*a*, 6*b*, 6*c*, 6*d*, 6*e*, 6*f*, 6*g*, 6*h*).

It should be noted, therefore, that the memory contains a set of power values (each value relating to one electric household appliance) and a plurality of digital data items used to represent the electric household appliances.

Thus, the nominal absorbed power values of electric household appliances are unambiguously associated with the digital data used to represent the electric household appliances.

The memory may or may not form part of the exercise machine 1.

In effect, the memory might also be a remote memory which is not part of the exercise machine 1 but which is connectable to the exercise machine 1.

The machine 1 also comprises a computer 5 which is programmed to compare the power detected by the detection means 4 with one (or more) of the power values stored in the memory.

The computer 5 is configured to generate a graphical output 9 of the comparison.

The graphical output 9 comprises a graphical representation 10 generated based on the digital data stored in the memory and representing an electric household appliance.

The exercise machine also comprises a display 7 connected to the computer 5 to allow the user to view the graphical output 9.

The display 7 is mounted in such a way as to be visible to the user during the workout.

Figure 4:
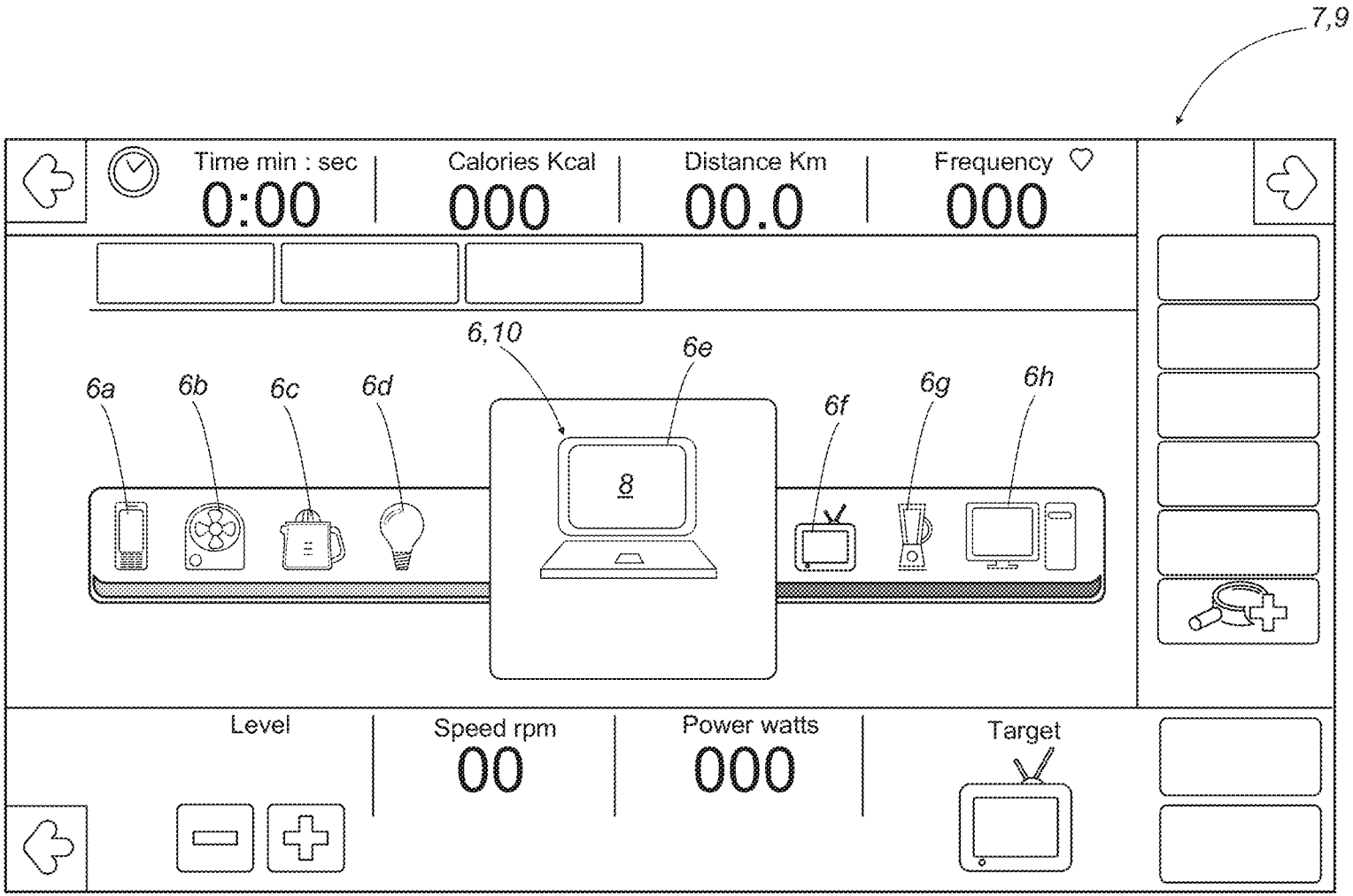

FIG. 4 shows some examples of preferred household appliances (whose respective operating power values are stored in the memory).

These electric household appliances are, for example, a mobile phone, a fan, a blender, a light bulb, a laptop, a television, a juicer and a desktop PC.

Preferably, the memory contains nominal power values which are absorbed by the electric household appliances and which the user is capable of supplying during a normal workout (that is, without excessive effort).

In other words, it should be noted that the invention contemplates comparing the detected power with the operating power values of the electric household appliances stored in the memory and generating a graphical output on the display as a function of the comparison and comprising a graphical representation of an electric household appliance (corresponding to one of the nominal absorbed power values stored in the memory).

This has a particularly strong motivational effect because the user is not only provided with effective feedback but with feedback in the form of a comparison with the power of an everyday object well known to the user.

Described below are some preferred modes of performing the comparison.

It should be noted, therefore, that the computer 5 can be configured in different modes, as described below.

In a first mode, the computer 5 is configured to compare the power detected by the detection means with a plurality of power values stored in the memory.

In this embodiment, therefore, the graphical representation 10 on the display 7 depends on the power detected by the detection means 4.

To clarify the above better, it should be noted that the computer 5—in this embodiment—displays on the display 7 a representation of one or more electric household appliances as a function of the power value detected (based on a suitable selection algorithm).

For example, the computer 5 might be configured in such a way that the graphical representation 10 shows one or more of the electric household appliances whose nominal absorbed power is less than the detected power value.

In other words, the computer 5 is preferably configured to compare the nominal operating powers of all the electric household appliance stored in the memory with the detected power value and to generate on the display the graphical representation of the electric household appliance/appliances whose nominal operating power is less than the power generated by the user.

Still more preferably, the computer 5 is configured to generate on the display the graphical representation of the electric household appliance/appliances whose nominal operating power is less than and closest to the power generated by the user.

That way, the user immediately perceives which appliance/appliances could be supplied with the power he/she is generating because the graphical representation appearing on the display shows the electrical household appliance/appliances which would be able to run on the power generated by the user during the workout.

In the same way, the computer 5 can be configured to compare the nominal operating powers of all the electric household appliance stored in the memory with the detected power value and to generate on the display the graphical representation of the electric household appliance/appliances whose nominal operating power is greater than the power generated by the user.

Still more preferably, the computer 5 is configured to generate on the display the graphical representation of the electric household appliance/appliances whose nominal operating power is greater than and closest to the power generated by the user.

That way, the user immediately perceives which appliance could be supplied by increasing the muscular power applied to the device. Thus, the graphical representation shows a target power for the user, thereby advantageously encouraging the user to reach that target during the workout.

In a second mode, the computer 5 compares the detected power with a single, user-selected power value stored in the memory. In this case, the graphical representation of the electric household appliance is independent of the detected power and depends on the selection made by the user before or during the workout.

It should be noted, therefore, that in this embodiment, the exercise machine 1 comprises a user interface 12 defining control means allowing the user to select from the plurality of power values stored in the memory the power value (that is, the electric household appliance) on which the comparison is to be performed and whose graphical representation is to be shown on the display 7.

These control means 12 may be touch-screen buttons (for example, built into the display 7 itself) or buttons of another type.

In this sense, the user might decide to perform the comparison on a particularly powerful appliance or with a less powerful appliance, depending on the personal target the user sets for himself/herself.

It should be noted that the modes described above can also be combined in the same exercise machine, that is to say, they are not mutually exclusive.

Described in more detail below are some examples of the graphical output 9 generated by the computer 5.

It is stressed, for clarity, that the graphical output 9 is generated by the computer 5 on the display 7 as a function of the comparison between the power applied to the device 2 and the nominal operating power of one or more of the electric household appliances 6 stored in the memory and comprises a graphical representation 10 corresponding to the electric household appliance 6 which is the object of comparison.

Preferably, the graphical representation 10 is in the form of an icon 8 depicting an electric household appliance.

Figure 3:
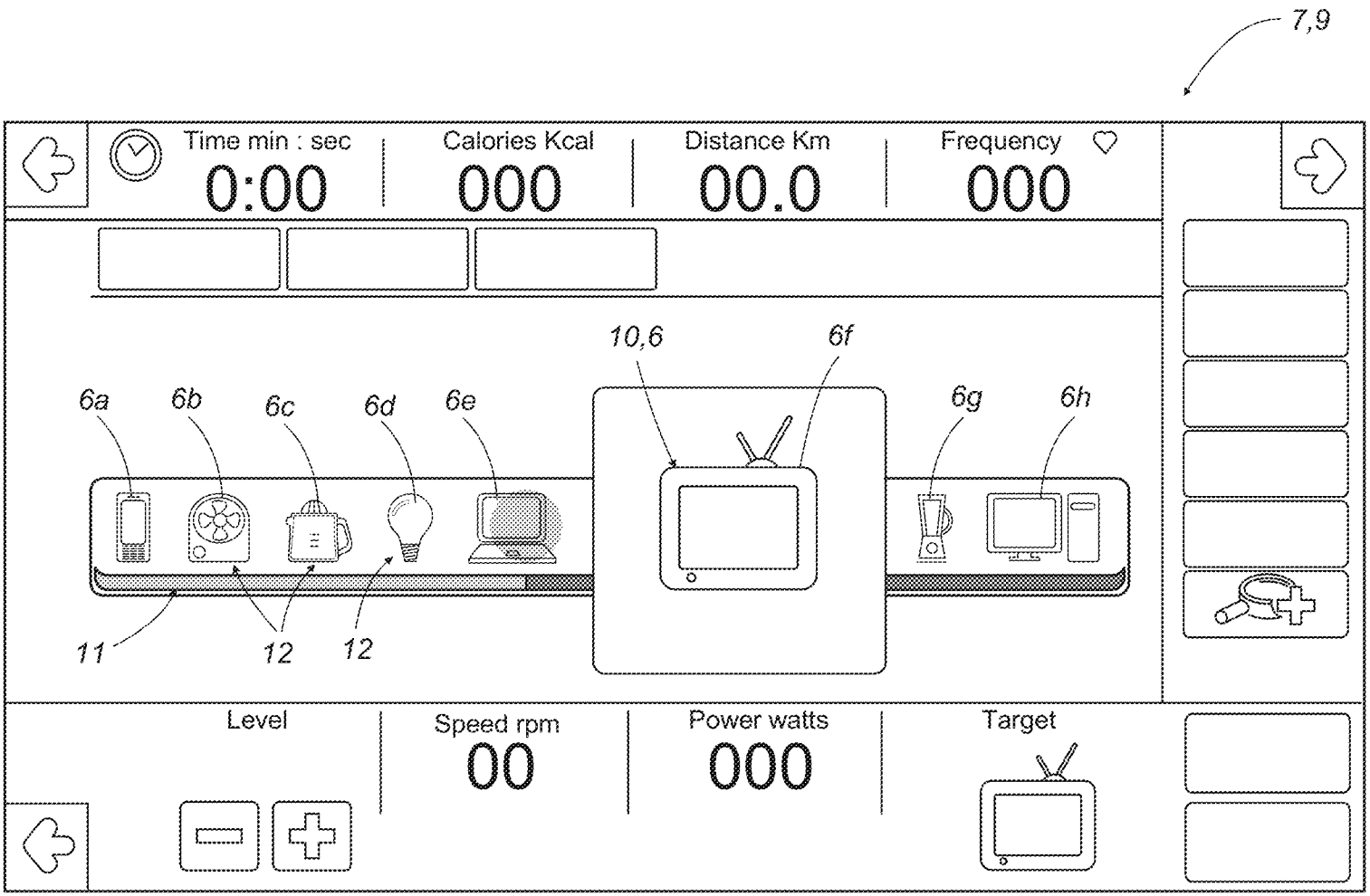
FIGS. 3 to 6 are respective schematic views of the display of the machine of FIGS. 1 and 2.

FIG. 3 illustrates one such graphical representation 10. Obviously, this must be understood purely as an example.

The graphical representation 10 shown in FIG. 3 is an icon 8 representing a television.

Preferably, the computer is programmed to generate on the display 7 an indication which shows if the power applied by the user to the device is greater than or less than the power of the selected electric household appliance.

Still more preferably, the computer is programmed to calculate a difference between the power applied by the user to the device and the power of the selected electric household appliance and to generate on the display 7 an indication of that difference.

It should be noted that FIGS. 3 and 4 show a plurality of graphical representations of electric household appliances.

Preferably, the computer 5 is programmed to generate on the display 7 graphical representations of the plurality of electric household appliances.

In a first mode of generating the graphical output 9, the icon 8 adopts a predetermined background color according to the result of the comparison between the detected power and the power of one of the electric household appliances stored in the memory (in the example illustrated in FIG. 3, the electric household appliance subjected to comparison is a television).

Preferably, a portion of the internal region of the icon 8 is colored with a predetermined color and the extent of the portion is determined as a function of the difference between the mechanical power detected and the nominal operating power of the electric household appliance (that is, as a function of the comparison).

Thus, a small colored portion of the internal region of the icon 8 indicates a large difference between the detected power and the nominal power needed to keep the selected appliance in operation, whereas a large colored portion of the internal region of the icon indicates that the detected power is substantially the same as the power needed to keep the selected appliance in operation, that is to say, a small difference between the two power values.

It should be noted that the comparison is substantially instantaneous (meaning by this that the comparison is performed in a relatively small time interval giving a result which is closer to being an instantaneous value than a mean value).

In a different form of providing the graphical output 9 (which may be alternative to the one just described but which might also be combined with it), the icon 8 adopts a predetermined first color when the detected power is less than one of the nominal power values (whose graphical representation is shown on the display 7) and, otherwise, it adopts a second color.

For example, in the embodiment where the user selects the nominal absorbed power to be compared, if the detected power is greater than that corresponding to the power needed to keep the selected electric household appliance 6 in operation, the icon 8 is colored green and, otherwise, it takes on another color.

According to another aspect, the graphical output 9 may be provided in the form of a bar which is progressively colored as a function of the result of the comparison.

According to this aspect, the bar provides a non-dimensional comparison between the detected power and the predetermined power related to the electric household appliance.

According to a further aspect, the computer 5 is configured to generate and provide on the display a graphical indication 11 representing the detected power.

In FIG. 3, for example, this graphical indication 11 is a bar, which is colored in proportion to the detected power.

It should be noted that the graphical output 9 representing the comparison very effectively motivates and encourages the user to improve his/her performance during the workout.

In other words, providing a measure of the power the user is generating in comparison with a predetermined power corresponding to the power needed to operate an electric household appliance encourages the user to perform the workout in a particularly effective manner: indeed the user is provided with a highly effective comparison of his/her performance with the power needed to activate an everyday object such as an electric household appliance 6.

This has a highly motivating and encouraging effect on the user and also encourages competition between users.

Described below is a further aspect of the exercise machine of this invention.

It will be understood that this aspect can be combined with all the others described in the foregoing.

The exercise machine 1 may comprise means 13 for converting the mechanical energy (of the muscles) into electricity, said means being mechanically connected to the device 2 for converting into electricity the energy produced by the user while driving the device 2.

The energy conversion means 13 are connectable (that is, connected during the workout) to at least one user device 14 for the electricity.

By user device 14 for the electricity is meant any electrical device capable of receiving and storing the energy for later uses or using the energy immediately (for example, a light bulb, an electric household appliance, another exercise machine, etc.).

A machine of the type described above is defined as a "regenerative" machine.

Figure 2:
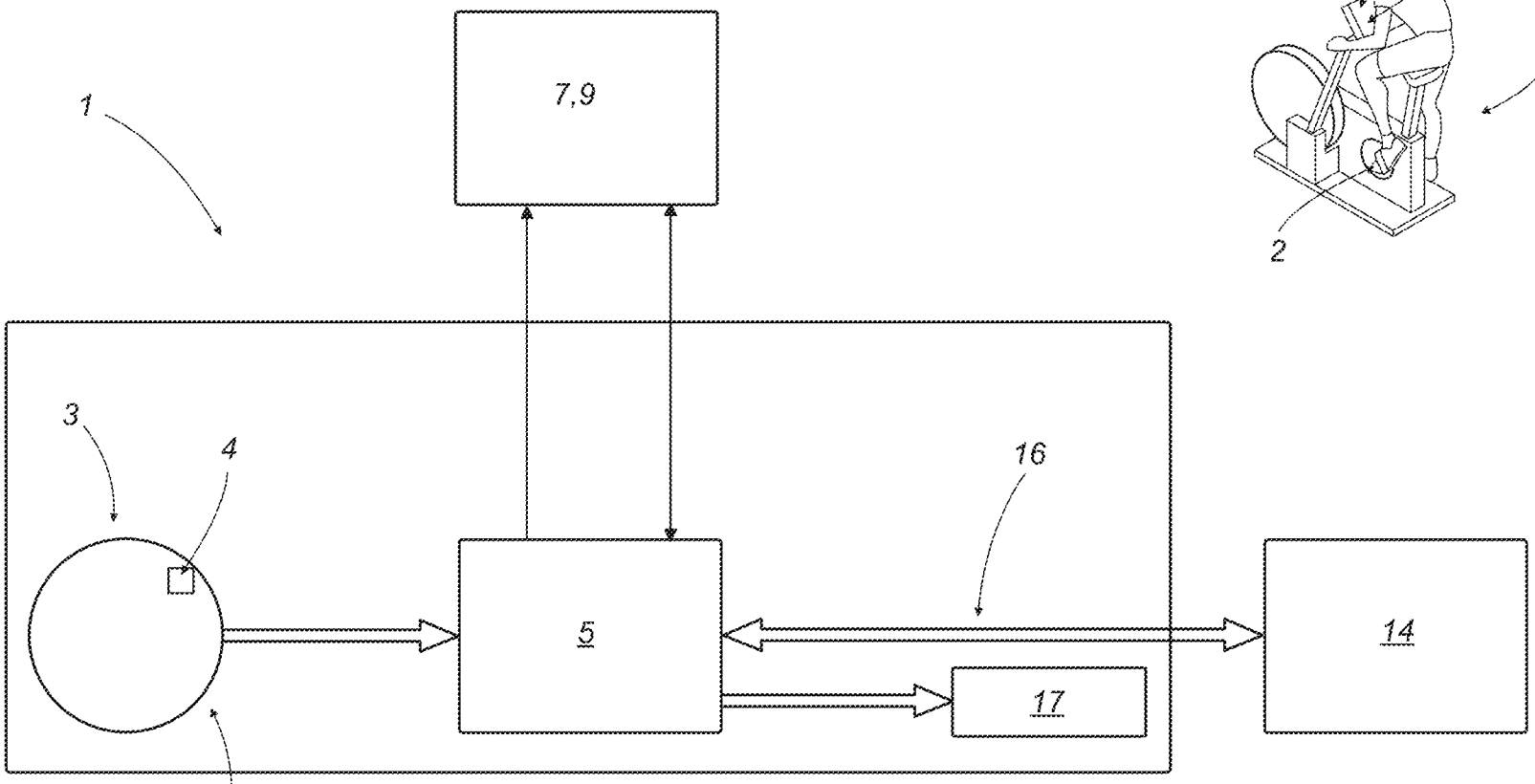
FIG. 2 schematically represents the machine of FIG. 1.

FIGS. 1 and 2 schematically illustrate a machine of the invention having an energy generating feature, that is to say, equipped with the conversion means 13.

The reference numeral 15 in FIG. 2 denotes an electric generator coupled to the device 2.

The electric generator 15 is configured to convert the mechanical power applied by the user to the device 2 into electrical power.

It should be noted that the generator 15, when it is coupled to an electric load, generates on the device 2 a resistant load 3 which opposes the movement of the device 2.

It should be noted that the generator 15 can be coupled to a common electric line 16 to send electricity to one or more user devices.

Preferably, the computer 5 is configured to allow the resistant load 3 to be adjusted as a function of the power value selected by the user (or by the computer).

This allows the resistant load to be varied as a function of a selection made by the user (or, otherwise, also as a function of a selection made by the computer 5) in accordance with what is described in the foregoing.

Preferably, the graphical representation of the electric household appliance on the display 7 represents the electric power generated by the user and made available to the user device 14.

The exercise machine 1 preferably also comprises a dissipator 17, that is to say, an electric energy dissipating device 17 (configured to use electric energy).

The computer 5 allows activating the connection between the generator 15 and the dissipating device 17 to dissipate a part of the electricity generated by the muscular power of the user. It should be noted that when the generator 15 is connected to the dissipating device 17, the resistant load 3 which the user has to overcome during the workout increases.

FIGS. 3 to 6 show some of the screen pages which appear on the display 7 of the exercise machine 1.

In the screen page of FIG. 3, the graphical output 9 comprises a plurality of graphical representations of electric household appliances (6*a*, 6*b*, 6*c*, 6*d*, 6*e*, 6*f*, 6*g*, 6*h*) and an enlarged graphical representation of a television (in this case, the television is the selected appliance).

In the screen page of FIG. 4, on the other hand, the graphical output 9 comprises a plurality of graphical representations of electric household appliances (6*a*, 6*b*, 6*d*, 6*e*, 6*f*, 6*g*, 6*h*) and an enlarged graphical representation of a laptop computer.

Figure 5:
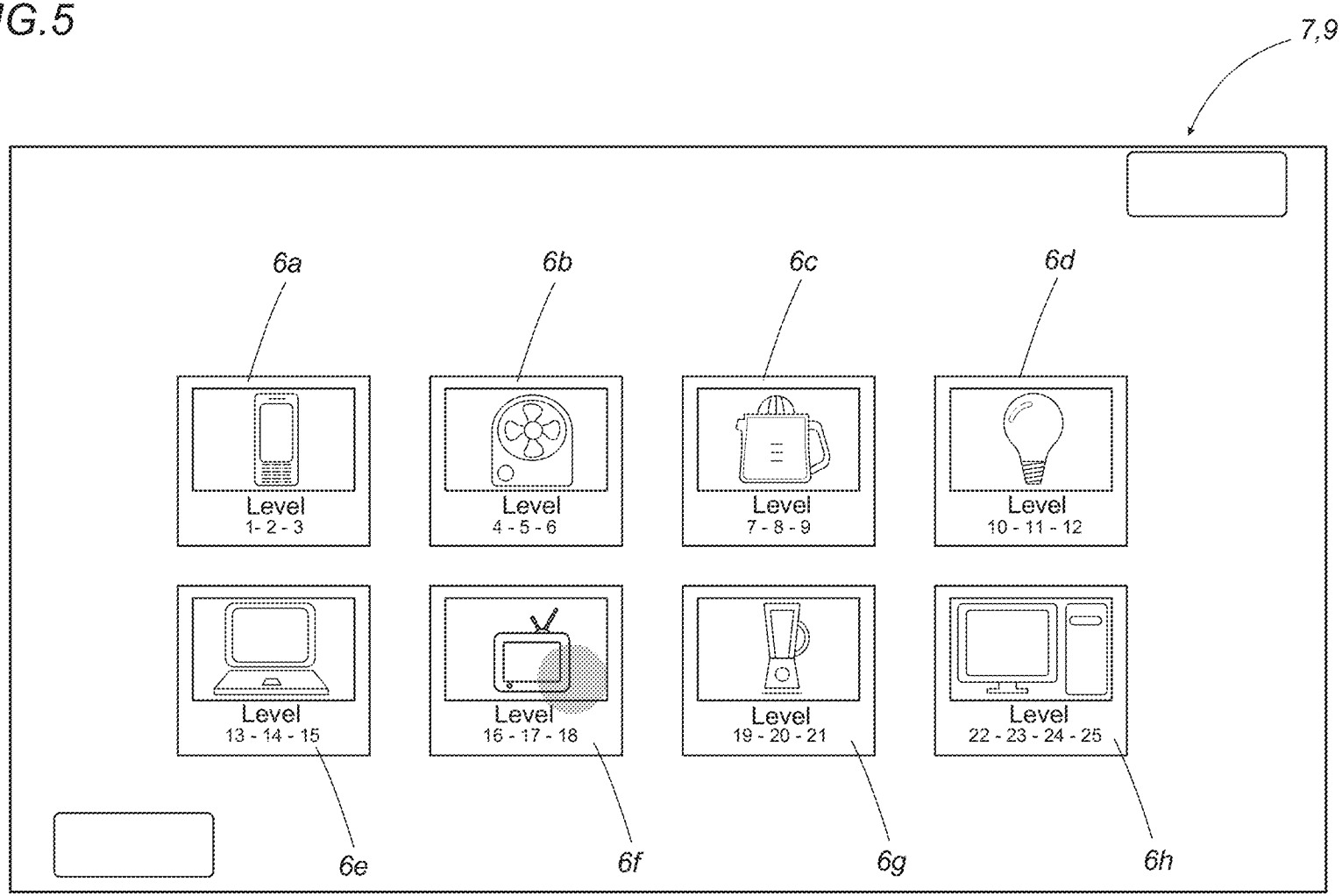

FIG. 5 shows a screen page where it is possible to display and select a power value from a plurality of power values corresponding to respective electric household appliances (6*a*, 6*b*, 6*c*, 6*d*, 6*e*, 6*f*, 6*g*, 6*h*).

Figure 6:
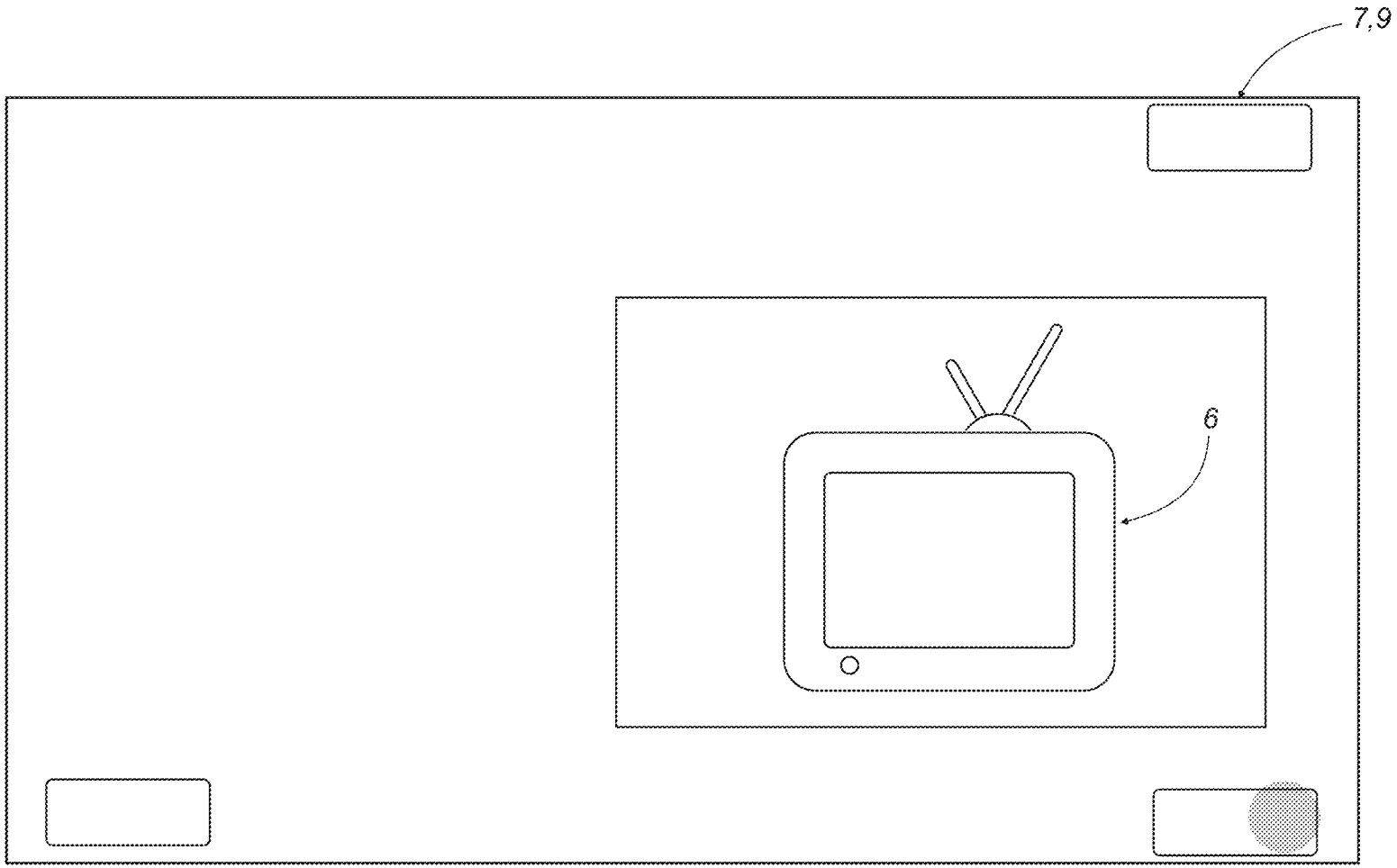

FIG. 6 illustrates a window which shows an electric household appliance, corresponding to the one selected by the user, and from which the user can start generating the graphical output 9 according to what is described above.

In a variant embodiment, an indication is displayed when the power generated by the user is greater than or equal to that of the selected appliance which is the object of comparison.

Preferably, the indication is in the form of a text message or involves applying a predetermined color to an icon or graphical representation.

In yet another variant embodiment, which can be combined with the one described above, an indication, preferably in the form of a text message, is displayed when the power generated by the user is less than that of the selected appliance which is the object of comparison.

According to yet another aspect, the exercise machine is configured to display data to the user which indicates the total amount of energy produced since the beginning of the workout, as well as $CO_2$ savings as a result of the total amount of energy produced (in effect, it should be noted that energy produced by muscular power allows savings of $CO_2$ compared to energy produced from fossil sources).

This data is preferably displayed on the display 7 of the exercise machine.

Also defined is a method for managing an exercise machine forming the object of this invention. The method comprises the following steps: preparing, in a memory, a plurality of values representative of the power nominally absorbed by a plurality of corresponding electric household appliances (6*a*, 6*b*, 6*c*, 6*d*, 6*e*, 6*f*, 6*g*, 6*h*) and digital data for graphically representing said plurality of electric household appliances; detecting the muscular power applied by the user to the device 2 during the workout; comparing, using the computer 5, the power detected by the detection means 4 and at least one of the power values contained in the memory; generating on the display, depending on the comparison, a graphical output 9 of said comparison, comprising a graphical representation 10 of at least one of the electric household appliances, generated based on the digital data.

What is claimed is:

1. An exercise machine equipped with a device (2) configured to be driven to move by the user during the workout, by applying a muscular force against a resistant load (3), and comprising:

detection means (4) for detecting the muscular power applied by the user to the device (2) during the workout;

a display (7);

a computer (5) connected to the display and having access to a memory containing a plurality of values, representative of the power nominally absorbed by a plurality of corresponding electric household appliances (6*a*, 6*b*, 6*c*, 6*d*, 6*e*, 6*f*, 6*g*, 6*h*), and digital data for graphically representing of said plurality of electric household appliances, the computer (5) being programmed for comparing the power detected by the detection means (4) and at least one of the power values contained in the memory; and for generating on the display, depending on said comparison, a graphical output (9) of said comparison, comprising a graphical representation (10) of at least one of the electric household appliances, generated based on the digital data.

2. The exercise machine according to claim 1, wherein the computer (5) is programmed to generate on the display (7) graphical representations of the plurality of electric household appliances, the machine comprising a user interface (12) connected to the computer for allowing the user to select one of the electric household appliances and the computer (5) being programmed for setting the value representative of the nominal power absorbed by the selected electric household appliance as a reference value for the comparison.

3. The exercise machine according to claim 1, wherein the computer (5) is programmed to perform the comparison in real time and is programmed to generate the graphical representations of the plurality of electric household appliances on the display (7) during the workout.

4. The exercise machine according to claim 1, wherein the computer is programmed to compare the power applied by the user to the device and the power of the selected electric household appliance and is also programmed to generate on the display (7) a graphical element for indicating if the power applied by the user to the device is greater than or less than the power of the selected electric household appliance.

5. The exercise machine according to claim 1, wherein the computer is programmed to calculate a difference between the power applied by the user to the device and the power of the selected electric household appliance and to generate on the display (7) an indication showing the value of that difference.

6. The exercise machine according to claim 1, wherein the computer (5) is programmed to compare the power applied by the user to the device and the power of the selected electric household appliance and to generate on the display (7) an icon (8) or a graphical representation of an electric household appliance which adopts a predetermined color depending on the result of the comparison.

7. The exercise machine according to claim 6, wherein the computer (5) is programmed to compare the power applied by the user to the device and the power of the selected electric household appliance and to assign to the icon (8) or graphical representation of an electric household appliance a predetermined first color when the power detected is less than the nominal power absorbed by the selected electric household appliance and a predetermined second color when the power detected is equal to or greater than the nominal power absorbed by the selected electric household appliance.

8. The exercise machine according to claim 1, wherein the computer (5) is programmed to perform a comparison between the power applied by the user to the device and the absorbed power values contained in the memory and to generate on the display (7), depending on said comparison, graphical representations of one or more electric household appliances having a nominal absorbed power which is less than the power value detected.

9. The exercise machine according to claim 1, wherein the computer (5) is programmed to perform a comparison between the power applied by the user to the device and the absorbed power values contained in the memory and to generate on the display (7), depending on said comparison, graphical representations of one or more electric household appliances having a nominal absorbed power which is greater than the power value detected.

10. The exercise machine according to claim 1, wherein the memory contains power values which are representative of the power nominally absorbed by electric household appliances, said values being within the range of from 30W to 2kW.

11. The exercise machine according to claim 1, wherein the plurality of electric household appliances comprises one or more of the following electric household appliances: a mobile phone; a fan; a blender; a light bulb; a laptop; a television; a juicer; and a desktop PC.

12. The exercise machine according to claim 1, comprising means (13) for converting the mechanical energy into electricity, said means being mechanically connected to the device (2) for converting the energy produced by the user while driving the device (2) into electricity, and said means being connectable to at least one user device (14) for the electricity for at least partly forming the resistance load (3), and wherein the graphical representation of the electric household appliance is representative of the electricity generated by the user and made available to the user device (14).

13. A method for managing an exercise machine equipped with a device (2) designed to be driven to move by the user during the workout, by applying a muscular force against a resistant load (3) and comprising a display (7) and a computer (5) connected to the display, comprising the following steps:

preparing, in a memory, a plurality of values representative of the power nominally absorbed by a plurality of corresponding electric household appliances (6*a*, 6*b*, 6*c*, 6*d*, 6*e*, 6*f*,6*g*, 6*h*) and digital data for graphically representing said plurality of electric household appliances detecting the muscular power applied by the user to the device (2) during the workout;

comparing, using the computer (5), the power detected by the detection means (4) and at least one of the power values contained in the memory;

generating on the display, depending on the comparison, a graphical output (9) of said comparison, comprising a graphical representation (10) of at least one of the electric household appliances, generated based on the digital data.

* * * * *